US007453252B1

(12) United States Patent
Megaw

(10) Patent No.: US 7,453,252 B1
(45) Date of Patent: Nov. 18, 2008

(54) CIRCUIT AND METHOD FOR REDUCING REFERENCE VOLTAGE DRIFT IN BANDGAP CIRCUITS

(75) Inventor: David J. Megaw, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 49 days.

(21) Appl. No.: 10/924,661

(22) Filed: Aug. 24, 2004

(51) Int. Cl.
*G05F 3/30* (2006.01)

(52) U.S. Cl. ..... 323/313; 323/316

(58) Field of Classification Search ..... 323/313, 323/314, 316; 327/539, 541
See application file for complete search history.

(56) References Cited

U.S. PATENT DOCUMENTS

| | | | | |
|---|---|---|---|---|
| 4,250,445 | A | 2/1981 | Brokaw | |
| 4,939,442 | A * | 7/1990 | Carvajal et al. | 323/281 |
| 5,168,209 | A * | 12/1992 | Thiel | 323/313 |
| 5,291,122 | A * | 3/1994 | Audy | 323/313 |
| 5,373,226 | A * | 12/1994 | Kimura | 323/313 |
| 5,432,432 | A | 7/1995 | Kimura | |
| 5,519,308 | A | 5/1996 | Gilbert | |
| 5,629,611 | A * | 5/1997 | McIntyre | 323/313 |
| 5,767,664 | A * | 6/1998 | Price | 323/313 |
| 5,952,873 | A * | 9/1999 | Rincon-Mora | 327/539 |
| 6,075,354 | A * | 6/2000 | Smith et al. | 323/313 |
| 6,118,264 | A | 9/2000 | Capici | |
| 6,218,822 | B1 * | 4/2001 | MacQuigg | 323/313 |
| 6,563,370 | B2 | 5/2003 | Coady | |
| 6,580,258 | B2 * | 6/2003 | Wilcox et al. | 323/282 |
| 6,650,175 | B2 * | 11/2003 | Messager | 327/541 |
| 6,724,176 | B1 | 4/2004 | Wong et al. | |
| 6,791,307 | B2 * | 9/2004 | Harrison | 323/312 |
| 6,858,917 | B1 * | 2/2005 | Ranucci | 257/580 |
| 7,053,694 | B2 * | 5/2006 | Ozawa | 327/539 |
| 2005/0073290 | A1 * | 4/2005 | Marinca et al. | 323/907 |

OTHER PUBLICATIONS

Made Gunawan et al., "A Curvature-Corrected Low-Voltage Bandgap Reference", IEEE Journal of Solid-State Circuits, vol. 28, No. 6, Jun. 1993, pp. 667-670.

* cited by examiner

*Primary Examiner*—Jeffrey L. Sterrett
*Assistant Examiner*—Harry Behm

(57) ABSTRACT

A circuit includes a bandgap core and a bandgap amplifier. The bandgap core is capable of receiving an input voltage and generating an output voltage. A second-order temperature coefficient in the output voltage is at least partially reduced by the bandgap core while a first-order temperature coefficient in the output voltage remains substantially unchanged.

13 Claims, 2 Drawing Sheets

CIRCUIT AND METHOD FOR REDUCING REFERENCE VOLTAGE DRIFT IN BANDGAP CIRCUITS

TECHNICAL FIELD

This disclosure is generally directed to bandgap circuits and more specifically to a circuit and method for reducing reference voltage drift in bandgap circuits.

BACKGROUND

Bandgap circuits are used in many different types of applications. For example, a bandgap circuit is often used to generate a reference voltage provided to other components in a circuit. A reference voltage produced by a bandgap circuit typically suffers from a finite amount of temperature dependence commonly known as "drift." This drift often appears as zero-order, first-order, and/or second-order or other higher-order temperature coefficients in the reference voltage. The second-order and other higher-order temperature coefficients usually cause curvature in the reference voltage as a function of temperature.

High-precision bandgap circuits often include additional circuitry to reduce curvature of the reference voltages, often referred to as "curvature compensation." For example, a correction current may be injected into a core of a bandgap circuit. This typically results in a reduction in the curvature of the reference voltage. However, this approach typically increases the complexity, power consumption, and size of the bandgap circuits. Also, conventional curvature compensation techniques typically affect the zero-order and first-order temperature coefficients as well as the intended higher-order temperature coefficients. Curvature compensation techniques that have a strong effect on the zero-order and first-order temperature coefficients are problematic because it becomes more difficult to achieve accurate zero-order and minimized first-order and second-order temperature coefficients at the same time.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
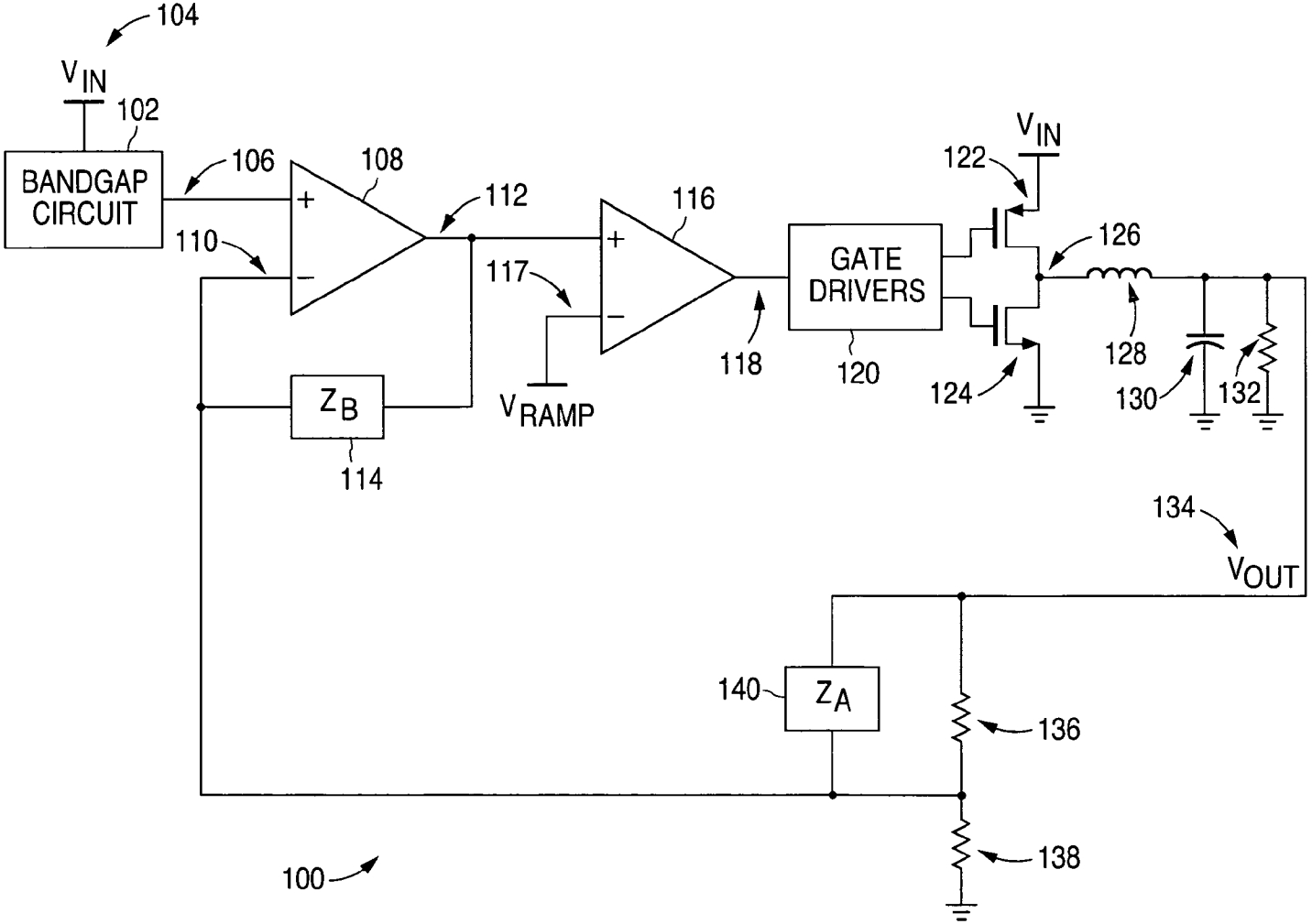
FIG. 1 is a block diagram illustrating an example switching regulator circuit according to one embodiment of this disclosure.

FIG. 1 is a block diagram illustrating an example switching regulator circuit 100 according to one embodiment of this disclosure. The switching regulator circuit 100 shown in FIG. 1 is for illustration only. Other embodiments of the switching regulator circuit may be used without departing from the scope of this disclosure.

Figure 2:
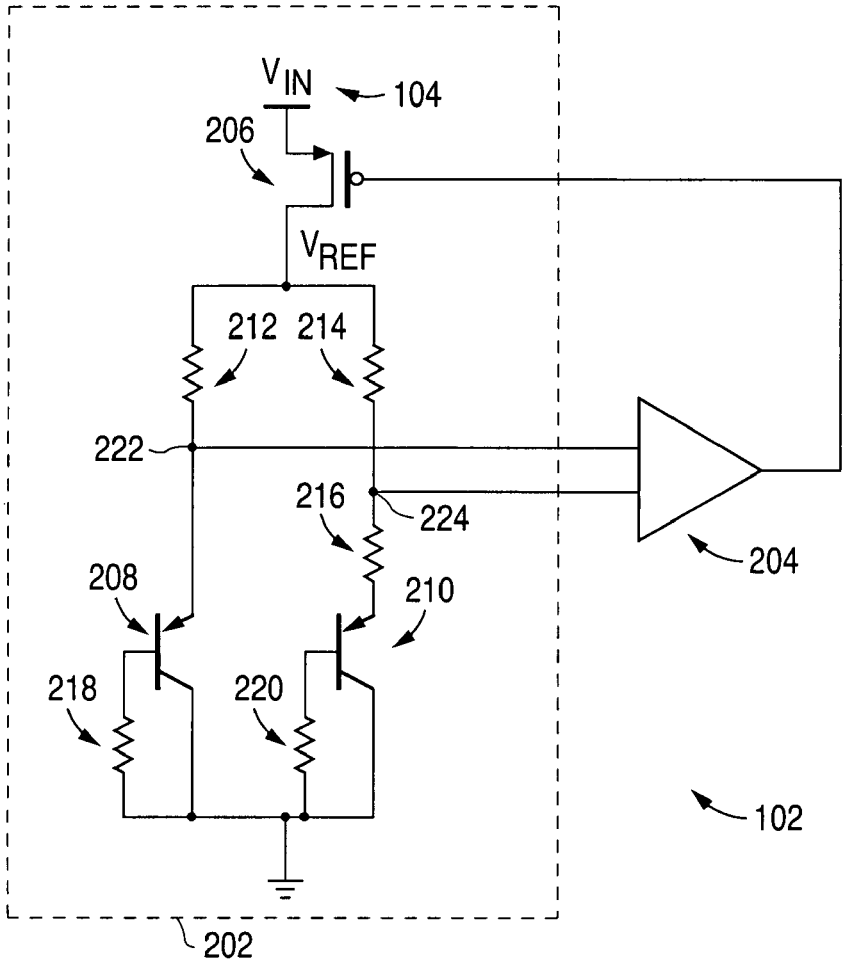
FIG. 2 is a block diagram illustrating an example bandgap circuit according to one embodiment of this disclosure.

In the illustrated example, the switching regulator circuit 100 includes a bandgap circuit 102. The bandgap circuit 102 is capable of receiving an input voltage ($V_{IN}$) 104 and generating a reference voltage ($V_{REF}$) 106. For example, the bandgap circuit 102 could generate a reference current that is passed through a resistor to produce the reference voltage 106. The bandgap circuit 102 includes any circuitry capable of generating a reference voltage 106 or other voltage from an input voltage 104. The bandgap circuit 102 may include, for example, a bandgap core and a bandgap amplifier. One embodiment of the bandgap circuit 102 is shown in FIG. 2, which is described below.

The bandgap circuit 102 is coupled to an amplifier 108. In this document, the term "couple" and its derivatives refer to any direct or indirect communication between two or more components, whether or not those components are in physical contact with one another. The amplifier 108 amplifies a difference between the reference voltage 106 produced by the bandgap circuit 102 and a second voltage 110. Based on the difference, the amplifier 108 generates an output voltage 112. For example, the amplifier 108 may generate a higher output voltage 112 when the reference voltage 106 is greater than the second voltage 110 and a lower output voltage 112 when the reference voltage 106 is smaller than the second voltage 110. The second voltage 110 may, at least in part, be based on a prior output voltage 112 that is provided to an impedance 114. The impedance 114 may represent any suitable impedance.

The output voltage 112 from the amplifier 108 is provided to a comparator 116. The comparator 116 compares the output voltage 112 to a ramp voltage ($V_{RAMP}$) 117. The comparator 116 then generates an output voltage 118 based on the comparison. For example, the comparator 116 may generate a high output voltage 118 when the voltage 112 is greater than the ramp voltage 117 and a low output voltage 118 when the voltage 112 is smaller than the ramp voltage 117.

The output voltage 118 is provided to gate drivers 120. The gate drivers 120 are capable of supplying a control voltage to the gates of transistors 122-124. For example, depending on the output voltage 118, the gate drivers 120 could supply a high voltage to the gate of the transistor 122 and a low voltage to the gate of the transistor 124, or vice versa.

A voltage at a connection point 126 between the transistors 122-124 is provided to an inductor 128. The inductor 128 is connected to a capacitor 130 and a resistor 132. The inductor 128, capacitor 130, and resistor 132 may have any suitable inductance, capacitance, and resistance, respectively. The output of the inductor 128 and capacitor 130 represents an output voltage ($V_{OUT}$) 134.

The output voltage 134 is then supplied to a load. In this example, the load includes two resistors 136-138 and an impedance 140. The resistors 136-138 and the impedance 140 may have any suitable resistances and impedance, respectively. For example, the resistors 136-138 may have equal or approximately equal resistances. In particular embodiments, the load receiving the output voltage 134 may represent a high impedance load.

As described above, the bandgap circuit 102 generates a reference voltage 106. In one aspect of operation, the bandgap circuit 102 may generate a reference current that is passed through a resistor to produce the reference voltage 106. The bandgap circuit 102 may suffer from drift, such as when the reference voltage 106 drifts in relation to the temperature of the bandgap circuit 102. This results in the curvature of the reference voltage 106 as the temperature varies.

To compensate for this curvature, the bandgap circuit 102 includes resistors that cause the addition of a second-order term to the reference current produced by the bandgap circuit 102. As described in more detail below, the second-order term added to the reference current is controllable. As a result, the reference voltage 106 produced using this reference current has a controllable second-order temperature dependence.

This may be used to reduce or cancel the second-order temperature coefficient in the reference voltage that results in drift.

Ideally, only the second-order temperature coefficient in the reference voltage 106 is altered, without affecting the zero-order and first-order temperature coefficients in any significantly way. The bandgap circuit 102 may typically be operated to produce a particular reference voltage 106 that minimizes the first-order temperature coefficient. That reference voltage 106 is typically referred to as the "magic voltage." If the resistors used to reduce or eliminate the second-order temperature coefficient do not significantly alter either the zero-order or the first-order temperature coefficient, the resistors would not significantly affect the magic voltage of the bandgap circuit 102.

The mechanism for reducing or eliminating the second-order temperature coefficient in a reference voltage 106 may be used in any suitable bandgap circuit 102. For example, the mechanism may be used in a "Brokaw Cell" bandgap reference circuit that produces a proportional to absolute temperature ("PTAT") reference current. The mechanism could also be used in sub-bandgap voltage references that rely on PTAT currents. In addition, the mechanism could be used in other or additional circuits.

Although FIG. 1 illustrates one example of a switching regulator circuit 100, various changes may be made to FIG. 1. For example, other or additional embodiments of the switching regulator circuit may be used. Also, the switching regulator circuit 100 shown in FIG. 1 represents one possible environment in which the bandgap circuit 102 may be used. The bandgap circuit 102 may be used in any other circuit, device, or system.

FIG. 2 is a block diagram illustrating an example bandgap circuit 102 according to one embodiment of this disclosure. The bandgap circuit 102 shown in FIG. 2 is for illustration only. Other embodiments of the bandgap circuit 102 may be used without departing from the scope of this disclosure.

In this example, the bandgap circuit 102 includes a bandgap core 202 and a bandgap amplifier 204. The bandgap core 202 includes three transistors 206-210 and five resistors 212-220. This represents one of many possible embodiments of the bandgap core 202. Other embodiments of the bandgap core 202 could be used in the bandgap circuit 102.

The transistor 206 has a source coupled to the input voltage 104, a gate coupled to the amplifier 204, and a drain coupled to the resistors 212-214. The transistor 208 has an emitter coupled to the resistor 212, a base coupled to the resistor 218, and a collector coupled to ground. The transistor 210 has an emitter coupled to the resistor 216, a base coupled to the resistor 220, and a collector coupled to ground. The transistors 206-210 may represent any suitable transistors. The transistor 206 may, for example, represent a p-channel field effect transistor. The transistors 208-210 may, for example, represent pnp bipolar transistors.

The resistor 212 is coupled to the transistors 206-208. The resistor 214 is coupled to the transistor 206 and the resistor 216. The resistor 216 is coupled to the resistor 214 and the transistor 210. The resistors 212-216 may have any suitable resistances. In some embodiments, the resistors 212-214 have equal or approximately equal resistances. As a particular example, the resistors 212-214 may each represent a 280 kΩ resistor. Also, the resistor 216 may represent a 27 kΩ resistor.

The two resistors 218-220 that are coupled to the bases of the transistors 208-210 are used to compensate for drift experienced by the bandgap circuit 102. The resistors 218-220 may have any suitable fixed or adjustable resistances. For example, the resistors 218-220 could have fixed values that generally reduce the effects of drift in the bandgap circuit 102. The resistors 218-220 could also be trimmable or adjustable to account for process variation. One mechanism for selecting the resistances of the resistors 218-220 is described below.

The resistors 218-220 cause the addition of a second-order term to the reference current produced by the bandgap circuit 102. The reference voltage 106 produced using this reference current has a controllable second-order temperature dependence, which is used to cancel the second-order coefficient in the reference voltage 106. The reference current may, for example, represent a PTAT current flowing through the resistors 212-214.

Although each of the various resistors 212-220 are shown in FIG. 2 as being single resistors, each of the resistors 212-220 could represent one or multiple resistors. For example, each of the resistors 212-220 could represent a single resistor, multiple resistors coupled in series, multiple resistors coupled in parallel, and/or multiple resistors coupled in series and in parallel.

In this embodiment, the bandgap amplifier 204 is connected in a negative feedback configuration. The amplifier 204 drives the bandgap core 202 such that the current through the resistor 212 is equal or approximately equal to the current through the resistor 214.

The following equations are used to illustrate the operation of the example bandgap circuit 102 shown in FIG. 2. These equations are for illustration only. Other embodiments of the bandgap circuit 102 that operate in a different manner and depart from these equations may be used. Also, these equations are based on several assumptions. Other bandgap circuits 102 that operate based on one or more different assumptions may also be used.

In this example embodiment, the voltages at two points 222-224 in the bandgap circuit 102 (the inputs to the amplifier 204) may be expressed as:

$$V_P = V_T \ln\left(\frac{I_1}{I_{SAT}}\right) + \left(\frac{I_1}{\beta+1}\right)\cdot R_1 \tag{1}$$

$$V_N = V_T \ln\left(\frac{I_2}{K\cdot I_{SAT}}\right) + \left(\frac{I_2}{\beta+1}\right)\cdot R_2 + (I_2\cdot R_\Delta) \tag{2}$$

where $V_P$ represents the voltage at point 222, $V_N$ represents the voltage at point 224, $V_T$ represents the thermal voltage of the bandgap circuit 102 (Boltzman's constant, k, times the temperature in Kelvin, T, divided by the charge of an electron, q), $I_1$ represents the current through resistor 212, $I_2$ represents the current through resistor 214, $I_{SAT}$ represents the saturation current of the transistors 208-210, β represents the current gain of the transistors 208-210, $R_1$ represents the resistance of the resistor 218, $R_2$ represents the resistance of the resistor 220, $R_\Delta$ represents the resistance of the resistor 216, and K represents the factor of the transistor 210. In this example, the transistor 208 is assumed to have a factor of one, and the transistor 210 is assumed to have a factor of K.

The bandgap amplifier 204 causes the voltage at point 222 ($V_P$) to approximately equal the voltage at point 224 ($V_N$). This causes the current through the resistor 212 ($I_1$) to approximately equal the current through the resistor 214 ($I_2$). Because of that, equations (1) and (2) may be rewritten as:

$$V_T \ln\left(\frac{I_1}{I_{SAT}}\right) + \left(\frac{I_1}{\beta+1}\right)\cdot R_1 \cong V_T \ln\left(\frac{I_2}{K\cdot I_{SAT}}\right) + \left(\frac{I_2}{\beta+1}\right)\cdot R_2 + (I_2\cdot R_\Delta) \tag{3}$$

-continued $$V_T\ln\left(\frac{I_2}{I_{SAT}}\right)+\left(\frac{I_2}{\beta+1}\right)\cdot R_1 \cong V_T\ln\left(\frac{I_2}{K\cdot I_{SAT}}\right)+\left(\frac{I_2}{\beta+1}\right)\cdot R_2+(I_2\cdot R_\Delta) \tag{4}$$

$$V_T\ln\left(\frac{I_2}{I_{SAT}}\right)-V_T\ln\left(\frac{I_2}{K\cdot I_{SAT}}\right) \cong -\left(\frac{I_2}{\beta+1}\right)\cdot R_1+\left(\frac{I_2}{\beta+1}\right)\cdot R_2+(I_2\cdot R_\Delta) \tag{5}$$

$$V_T\ln(K)=I_2\left[R_\Delta+\frac{(R_2-R_1)}{(\beta+1)}\right] \tag{6}$$

$$I_2=\frac{V_T\ln(K)}{\left[R_\Delta+\frac{(R_2-R_1)}{(\beta+1)}\right]}. \tag{7}$$

Assume that the temperature dependence of the resistor 216 is ignored ($R_\Delta(T)\cong R_\Delta$). The temperature dependence of the resistors 218-220 may be expressed as:

$$R_1(T)=R_{10}\cdot(1+\alpha_1 T+\gamma_1 T^2) \tag{8}$$

$$R_2(T)=R_{20}\cdot(1+\alpha_2 T+\gamma_2 T^2) \tag{9}$$

where $R_{10}$ represents the temperature independent portion of $R_1$, $R_{20}$ represents the temperature independent portion of $R_2$, $\alpha_1$ represents the first-order temperature coefficient associated with the resistor 218, $\alpha_2$ represents the first-order temperature coefficient associated with the resistor 220, $\gamma_1$ represents the second-order temperature coefficient associated with the resistor 218, $\gamma_2$ represents the second-order temperature coefficient associated with the resistor 220, and T represents the temperature of the resistors 218-220 in Kelvin.

The temperature dependence of the current $I_2$ through the resistor 214 may be expressed as:

$$I_2(T)=\frac{\frac{kT}{q}\ln(K)}{\left[R_\Delta+\frac{(R_2(T)-R_1(T))}{(\beta(T)+1)}\right]} \tag{10}$$

$$I_2(T)=\frac{kT}{q}\ln(K)\cdot\frac{1}{R_{EQ}(T)} \tag{11}$$

$$R_{EQ}(T)=R_\Delta+\left[\frac{(R_{20}-R_{10})+(\alpha_2 R_{20}-\alpha_1 R_{10})\cdot T+(\gamma_2 R_{20}-\gamma_1 R_{10})\cdot T^2}{\beta(T)+1}\right] \tag{12}$$

where k represents Boltzmann's constant and q represents the charge of an electron. Assume that $\beta>>1$. Also assume that $$\beta(T)\cong\beta_N\cdot\left(\frac{T}{T_N}\right),$$

where $\beta_N$ represents a normalized $\beta$ value and $T_N$ represents a normalized temperature. This is based on an assumption that $\beta$ has an approximate linear temperature dependence in the temperature range of interest. As a particular example, $\beta$ may have an approximate linear temperature dependence in an industrial temperature range of −50° C. through 125° C., which is common for lateral and vertical pnp-type transistors in Complementary Metal Oxide Semiconductor (CMOS) technologies.

Using these assumptions, the following equations may be determined:

$$R_{EQ}(T)\cong R_\Delta+\left[\frac{(R_{20}-R_{10})}{\beta_N\left(\frac{T}{T_N}\right)}\right]+\left[\frac{(\alpha_2 R_{20}-\alpha_1 R_{10})\cdot T}{\beta_N\left(\frac{T}{T_N}\right)}\right]+\left[\frac{(\gamma_2 R_{20}-\gamma_1 R_{10})\cdot T^2}{\beta_N\left(\frac{T}{T_N}\right)}\right] \tag{13}$$

$$\frac{\partial}{\partial T}I_2(T)=\frac{k}{q}\ln(K)\cdot\frac{1}{R_{EQ}(T)}-\frac{kT}{q}\ln(K)\cdot\frac{1}{R_{EQ}^2(T)}\frac{\partial}{\partial T}(R_{EQ}(T)) \tag{14}$$

$$\frac{\partial}{\partial T}R_{EQ}(T)\cong\frac{\partial}{\partial T}\left[\frac{(R_{20}-R_{10})}{\beta_N\left(\frac{T}{T_N}\right)}\right]+\frac{\partial}{\partial T}\left[\frac{(\alpha_2 R_{20}-\alpha_1 R_{10})\cdot T}{\beta_N\left(\frac{T}{T_N}\right)}\right]+\frac{\partial}{\partial T}\left[\frac{(\gamma_2 R_{20}-\gamma_1 R_{10})\cdot T^2}{\beta_N\left(\frac{T}{T_N}\right)}\right]. \tag{15}$$

If the resistances of the resistors 218-220 are chosen such that $R_{10}=R_{20}$ and $\alpha_1=\alpha_2$, equations (15) and (13) may be rewritten as:

$$\frac{\partial}{\partial T}R_{EQ}(T)\cong\left[\frac{(\gamma_2 R_{20}-\gamma_1 R_{10})}{\left(\frac{\beta_N}{T_N}\right)}\right]=\left[\frac{R_{10}\cdot(\gamma_2-\gamma_1)}{\left(\frac{\beta_N}{T_N}\right)}\right] \tag{16}$$

$$R_{EQ}(T)\cong R_\Delta+\left[\frac{R_{10}\cdot(\gamma_2-\gamma_1)\cdot T}{\left(\frac{\beta_N}{T_N}\right)}\right]\approx R_\Delta. \tag{17}$$

For the sake of simplicity, assume that $R_{EQ}(T)$ is approximately equal to $R_\Delta$. This may appear to be counter to the goal of reducing the second-order temperature coefficient in the reference voltage 106 because the second-order temperature coefficient information is contained within $R_{EQ}$ (T). However, this allows for substantial simplification of the computations without sacrificing excessive accuracy. This is because the second-order temperature coefficient information of the current through the resistor 214, $I_2(T)$, is still contained within the partial derivative of $R_{EQ}(T)$. Based on this, equations (14) and (11) may be rewritten as:

$$\frac{\partial}{\partial T}I_2(T)\approx\frac{k}{q}\ln(K)\cdot\frac{1}{R_\Delta}-\frac{kT}{q}\ln(K)\cdot\frac{1}{R_\Delta^2}\left(\frac{\gamma_2 R_{20}-\gamma_1 R_{10}}{\left(\frac{\beta_N}{T_N}\right)}\right) \tag{18}$$

$$I_2(T)\approx\frac{kT}{q}\ln(K)\cdot\frac{1}{R_\Delta}-\frac{kT^2}{2q}\ln(K)\cdot\frac{1}{R_\Delta^2}\left(\frac{\gamma_2 R_{20}-\gamma_1 R_{10}}{\left(\frac{\beta_N}{T_N}\right)}\right). \tag{19}$$

The first term on the right hand side of equation (19) is the PTAT current. The second term is an introduced second-order temperature dependence caused by the difference in second-order temperature coefficients of the resistors 218-220. By scaling the difference between $R_{20}*\gamma_2$ and $R_{10}*\gamma_1$, the curvature of $I_2(T)$ can be well controlled, so the curvature of the PTAT voltage generated across the resistors 212-214 due to by $I_2(T)$ can also be controlled. The zero-order and first-order temperature dependence of $I_2(T)$ remains unchanged or approximately unchanged compared to the situation where $R_1=R_2=0$, meaning that the "magic voltage" of the reference voltage 106 is also substantially unchanged when this method of curve compensation is employed.

In some embodiments, the reference voltage 106 may be "propped" up by the voltage drop across the resistors 218-220. For example, the zero-order temperature coefficient of the reference voltage 106 may increase slightly. In practice, the base voltage caused by the resistors 218-220 may be on the order of a few millivolts, as shown in the following calculation:

$$V_{BI} = \frac{I_2(T)}{(\beta+1)} \cdot R_1 \cong \frac{kT}{q}\ln(K) \cdot \frac{R_1}{R_\Delta} \cdot \frac{1}{\beta}. \tag{20}$$

Let $V_{BG}(T)=V_{BG0}+C(T)$ so that the only temperature dependence of the voltage $V_{BG}$ is its inherent curvature described by the function C(T). When curve compensation is properly employed, C(T) may be expressed as:

$$C(T) \approx \frac{kT^2}{2q}\ln(K) \cdot \frac{R_0}{R_\Delta^2}\left(\frac{\gamma_2 R_{20} - \gamma_1 R_{10}}{\left(\frac{\beta_N}{T_N}\right)}\right). \tag{21}$$

Assuming $R_1(T) \cong R_{10} \cong R_{20}$, equations (21) and (20) may be rewritten as:

$$R_1 \approx \frac{C(T)}{\frac{kT^2}{2q}\ln(K) \cdot \frac{R_0}{R_\Delta^2} \cdot \frac{T_N}{\beta_N}(\gamma_2 - \gamma_1)} \tag{22}$$

$$V_{BI} \cong \frac{kT}{q}\ln(K) \cdot \frac{1}{R_\Delta} \cdot \frac{1}{\beta} \cdot \frac{C(T)}{\frac{kT^2}{2q}\ln(K) \cdot \frac{R_0}{R_\Delta^2} \cdot \frac{T_N}{\beta_N}(\gamma_2 - \gamma_1)} \cong \frac{C(T)}{T^2} \cdot \frac{R_\Delta}{R_0} \cdot \frac{2}{(\gamma_2 - \gamma_1)}. \tag{23}$$

C(T) may be purely a curvature term. As a result, let $C(T)=LT^2$. Equation (23) then may be rewritten as:

$$V_{BI} \cong \frac{R_\Delta}{R_0} \cdot \frac{2L}{(\gamma_1 - \gamma_2)}. \tag{24}$$

Some common values in these equations are:

$$L=3.7 \cdot 10^{-7}\ V/^\circ\ C.^2$$

$$\frac{R_\Delta}{R_0} = \frac{1}{10},$$

and $(\gamma_2-\gamma_1)=10$ ppm/° C.$^2$, causing $VB_1 \cong VB_2 \approx 8$ mv.

Because the base voltages caused by the resistors 218-220 are typically very small, the first-order temperature dependence of the resistors 218-220 ($\alpha_1$ and $\alpha_2$, respectively) may have a very small effect on the zero-order and first-order temperature dependence of the reference voltage 106. Also, process variations in the values of $R_{10}$ and $R_{20}$ may only weakly affect zero-order and first-order temperature dependence.

The values of the resistors 218-220 required for proper curve compensation may be found for a given circuit and process using equation (22). An approximation can be found using the following equation (using the common values shown above and assuming $\beta=20$ at 300K):

$$R_1 \cong R_2 \approx \frac{(2.5 \cdot 10^{-5}) \cdot R_\Delta}{(\gamma_2 - \gamma_1)}. \tag{25}$$

This curve compensation mechanism may be used in many different environments. For example, it may be used in any process that has two types of resistors with similar first-order temperature coefficients ($\alpha=\alpha_2$) and different second-order temperature coefficients ($\gamma_1 \neq \gamma_2$). As a particular example, it may be used in many CMOS technologies, which use poly resistors and lightly-doped drain resistors. As another particular example, composite resistors made from series and/or parallel combinations of two or more resistor types may be used for resistor 218 and/or resistor 220.

In particular embodiments, process variations in the values of $R_{10}$ and $R_{20}$ may change the second-order temperature coefficient of the current $I_2$. This may skew the curvature compensation. In some embodiments, if high accuracy is required, either or both of the resistors 218-220 may be trimmable to compensate for process variations.

Although FIG. 2 illustrates one example of a bandgap circuit 102, various changes may be made to FIG. 2. For example, the embodiment of the bandgap circuit 102 is for illustration only. Other embodiments, such as bandgap circuits with different bandgap cores or bandgap amplifiers, may be used.

Figure 3:
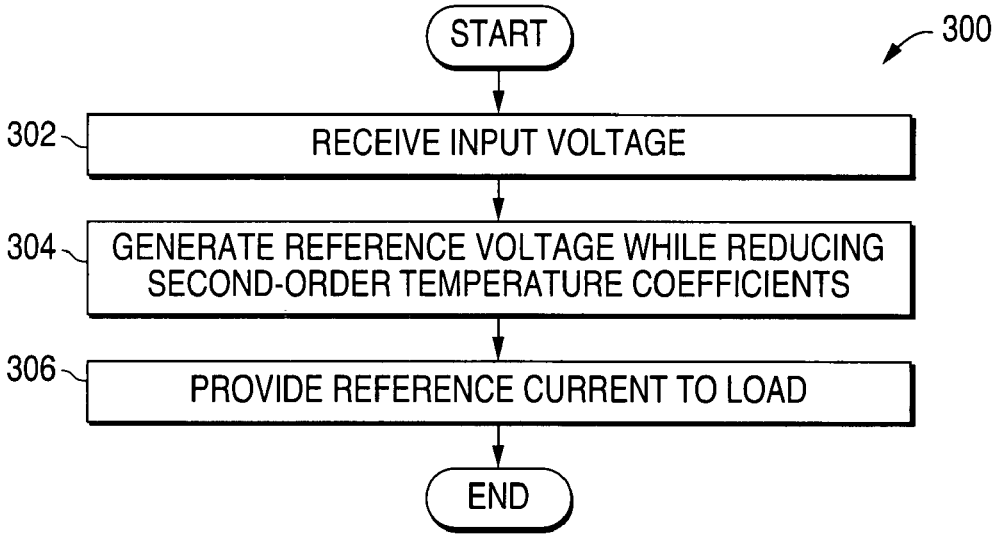
FIG. 3 is a flow diagram illustrating an example method for reducing reference voltage drift in a bandgap circuit according to one embodiment of this disclosure.

FIG. 3 is a flow diagram illustrating an example method 300 for reducing reference voltage drift in a bandgap circuit according to one embodiment of this disclosure. For ease of explanation, the method 300 is described with respect to the bandgap circuit 102 of FIG. 2.

A bandgap circuit 102 receives an input voltage 104 at step 302. This may include, for example, a transistor 206 receiving the input voltage 104 from a power supply or any other suitable voltage source.

The bandgap circuit 102 generates a reference voltage while reducing or eliminating the second-order temperature coefficient at step 304. This may include, for example, generating a reference current using the input voltage 104. The reference current is used to generate the reference voltage, such as by passing the reference current through one or more of the resistors 212-220. The resistors 218-220 reduce or eliminate the second-order temperature coefficient in the reference voltage produced by the bandgap circuit 102.

The bandgap circuit 102 provides the generated reference voltage to a load at step 306. This may include, for example, the bandgap circuit 102 providing the reference voltage to other components in a switching regulator circuit 100 or other circuit.

Although FIG. 3 illustrates one example of a method 300 for reducing reference voltage drift in a bandgap circuit 102, various changes may be made to FIG. 3. For example, the method could be used with any other suitable circuit.

It may be advantageous to set forth definitions of certain words and phrases that have been used within this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, software, firmware, or combination thereof. It should be noted that the functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A bandgap core, comprising:

a first transistor capable of receiving an input voltage;

a first resistor coupled to the first transistor;

a second resistor and a third resistor coupled in series to the first transistor;

a second transistor coupled to the first resistor;

a third transistor coupled to the third resistor;

a fourth resistor coupled between a base and a second terminal of the second transistor; and a fifth resistor coupled to a base of the third transistor and not coupled to the base of the second transistor, wherein a resistance of the fourth resistor is given by a formula of:

$$R_1 \approx \frac{C(T)}{\frac{kT^2}{2q}\ln(K)\cdot\frac{R_0}{R_\Delta^2}\cdot\frac{T_N}{\beta_N}(\gamma_2-\gamma_1)}$$

where R1 represents the resistance of the fourth resistor, C(T) represents a curvature of an output voltage of the bandgap core, k represents Boltzmann's constant, T represents a temperature in Kelvin, q represents a charge of an electron, R0 represents a resistance of the first and second resistors, RΔ represents a resistance of the third resistor, β represents a normalized current gain of the second and third transistors, TN represents a normalized temperature in Kelvin, γ1 represents a second-order temperature coefficient associated with the fourth resistor, and γ2 represents a second-order temperature coefficient associated with the fifth resistor.

2. The bandgap core of claim 1, wherein the second and third transistors comprise pnp bipolar transistors.

3. The bandgap core of claim 2, wherein:

the first resistor is coupled to an emitter of the second transistor; and the third resistor is coupled to an emitter of the third transistor.

4. The bandgap core of claim 1, wherein the first transistor comprises a p-channel field effect transistor.

5. The bandgap core of claim 4, wherein the first and second resistors are coupled to a drain of the field effect transistor.

6. The bandgap core of claim 1, further comprising an amplifier having a first input coupled to a point between the first resistor and the second transistor, a second input coupled to a point between the second and third resistors, and an output coupled to the first transistor.

7. The bandgap core of claim 1, wherein the fourth and fifth resistors have at least approximately equal first-order temperature coefficients and different second-order temperature coefficients.

8. The bandgap core of claim 1, wherein each of the fourth and fifth resistors comprises at least one of a trimmable resistor and an adjustable resistor.

9. The bandgap core of claim 1, where each of the resistors comprises one of: a single resistor, multiple resistors coupled in series, multiple resistors coupled in parallel, and multiple resistors coupled in series and in parallel.

10. A bandgap circuit, comprising:

a bandgap core capable of receiving an input voltage and generating an output voltage, wherein a second-order temperature coefficient in the output voltage is at least partially reduced by the bandgap core while a first-order temperature coefficient in the output voltage remains substantially unchanged; and a bandgap amplifier coupled to the bandgap core, wherein the bandgap core comprises:

a first transistor capable of receiving the input voltage;

a first resistor coupled to the first transistor;

a second resistor and a third resistor coupled in series to the first transistor;

a second transistor coupled to the first resistor;

a third transistor coupled to the third resistor;

a fourth resistor coupled to a base of the second transistor; and a fifth resistor coupled to a base of the third transistor, wherein a resistance of the fourth resistor is given by a formula of:

$$R_1 \approx \frac{C(T)}{\frac{kT^2}{2q}\ln(K)\cdot\frac{R_0}{R_\Delta^2}\cdot\frac{T_N}{\beta_N}(\gamma_2-\gamma_1)}$$

where R1 represents the resistance of the fourth resistor, C(T) represents a curvature of an output voltage of the bandgap core, k represents Boltzmann's constant, T represents a temperature in Kelvin, q represents a charge of an electron, R0 represents a resistance of the first and second resistors, RΔ represents a resistance of the third resistor, β represents a normalized current gain of the second and third transistors, TN represents a normalized temperature in Kelvin, γ1 represents a second-order temperature coefficient associated with the fourth resistor, and γ2 represents a second-order temperature coefficient associated with the fifth resistor.

11. The bandgap circuit of claim 10, wherein:

the second and third transistors comprise pnp bipolar transistors;

the first resistor is coupled to an emitter of the second transistor; and the third resistor is coupled to an emitter of the third transistor.

12. The bandgap circuit of claim 10, wherein:

the first transistor comprises a p-channel field effect transistor;

the first and second resistors are coupled to a drain of the field effect transistor; and the amplifier has a first input coupled to a point between the first resistor and the second transistor, a second input coupled to a point between the second and third resistors, and an output coupled to a gate of the first transistor.

13. The bandgap circuit of claim 10, wherein the fourth and fifth resistors have at least approximately equal first-order temperature coefficients and different second-order temperature coefficients.

* * * * *